United States Patent [19]

Kennedy

[11] 4,088,158

[45] May 9, 1978

[54] HEDDLE ROD HANGER ASSEMBLY

[75] Inventor: William P. Kennedy, Marietta, Ga.

[73] Assignee: Pioneer Heddle and Reed Company Incorporated, Atlanta, Ga.

[21] Appl. No.: 732,807

[22] Filed: Oct. 15, 1976

[51] Int. Cl.[2] ..... D03C 9/06

[52] U.S. Cl. ..... 139/92

[58] Field of Search ..... 139/91, 92

[56] References Cited

U.S. PATENT DOCUMENTS

| | | | |
|---|---|---|---|
| 2,623,548 | 12/1952 | Leveque | 139/92 |
| 3,221,776 | 12/1965 | Wagner | 139/92 |
| 3,362,437 | 1/1968 | Kaufmann | 139/92 |
| 3,417,788 | 12/1968 | Kramer | 139/92 |
| 3,470,920 | 10/1969 | Kaufmann et al. | 139/91 |
| 3,901,282 | 8/1975 | Kramer | 139/92 |

*Primary Examiner*—Henry S. Jaudon

*Attorney, Agent, or Firm*—Newton, Hopkins & Ormsby

[57] ABSTRACT

A loom harness having a conventional frame of side rails and top and bottom main rails. The heddle rods, carried by spring clips, support the heddles in the frame. Additional support is provided by hanger assemblies spaced laterally along the main rails. Each hanger assembly is formed of a pair of brackets which join together to surround the rail, one bracket carrying a plate with a tongue protruding through a slot in the main rail. The exposed portion of the plate has a sidewise extending lug received in a keyhole slot in the heddle frame. Lateral shifting of the heddle rod permits disengagement of the rod from the lug. A second embodiment provides a threaded member in the hanger assembly for limited vertical adjustment to the position of the heddle rod.

5 Claims, 7 Drawing Figures

HEDDLE ROD HANGER ASSEMBLY

BACKGROUND OF THE INVENTION

1. Field of the Invention

This invention relates to loom harnesses and, more particularly, to an improvement in a heddle rod hanger.

2. Description of the Prior Art

The advent of high-speed looms with substantially greater capability in cloth width and the use of a much greater amount of frames in the loom created the necessity of using extruded metal frame rails of small cross-sectional dimensions and of light weight so as to be compatible with logical mechanical capabilities and space limitations of the loom. To avoid sliding contact of adjacent frame rails nose guides were particularly desirable.

Early types of extruded metal rail frames incorporated integral heddle rods as a part of the rail. The desirability of heddle rod vertical adjustment led to the mounting of adjustable heddle rod supports within cutouts in the bottom of the top rail and the top of the bottom rail. These cutouts were of necessity of such a size that they substantially weakened the rails and caused buckling and tearing of the rails when in use.

The subsequent development of plastic nose guides with integral extensions of the plastic to provide a support on the nose guide for the attachment of a heddle rod came into use to avoid such substantial cutouts and to also perform the shedding action of a nose guide.

The thin cross section of these plastic extensions for the support of the heddle rods made them subject to stresses in action more than the ability of the plastic to withstand and they often broke apart at some point in the extension leaving the heddle rod unsupported and thereby stopping the use of the loom until the support was replaced. An early type of this support was a one-piece hanger, installed upon the rail by sliding it along the rail from a dismantled rail end. This entailed removing a great many frame components when it was necessary to replace a broken hanger. This difficulty of replacement led to the development of a one-piece plastic hanger with one end split in order to place the hanger on a rail without inserting it from one end. The split end of the hanger was held in closed position by means of fasteners, such as rivets or screws.

Attempts to preclude longitudinal movement of the hanger along the rail when the loom harness was in use included placing setscrews in the hangers and welding metal studs to the top and bottom of the rail. The cross-sectional area of the studs was too small to affort a dependable weld and the setscrews at times become loosened. Eventual attempts to solve this problem led to the practice of using rivets for fastening the heddle rod to the plastic extension which precluded lateral movement of the hanger upon the rail but necessitated the drilling out of the rivets to separate these parts in the event of breakage. Such operation almost always caused the mandatory removal of the frame from the loom.

The use of rivets to fasten the heddle rod to the plastic hanger extension often resulted in the breakage of the plastic around the rivet due to insufficient wall thickness of the plastic at this point due to the high speed vertical pounding action of the frames in motion. Space limitations govern the wall thickness of the extension in the proportion to space requirements of the associated heddles hanging from the heddle rod with the required movability clearances entailed within the narrow relationship of adjacent frame rails.

The use of an easily removable heddle rod was desirable for convenience and speed of repair but the fragility of the plastic in small cross-sectional area at this connection point was such that it led to further danger of breakage when the connection of heddle rod to hanger was made entirely of plastic in the configuration required by the usual horizontal slip joint connection of these parts.

Recent plastic hangers, which are held in closed positions upon the rails by means of integral snap fasteners, moulded into the hanger, have been devised. However, such fasteners at times become separated as a result of high speed vibrations of the frame, in operation. These hangers still use rivets between the heddle rod and the plastic projection to preclude lateral movement of the hanger along the rail. Such above described devices are shown in the patents to Kramer, U.S. Pat. No. 3,417,788; Kaufmann et al., U.S. Pat. No. 3,470,920; and Kramer et al., U.S. Pat. No. 3,901,282.

SUMMARY OF THE INVENTION

The above disadvantages are overcome by the present invention which includes, in the first embodiment, a heddle rod support assembly comprising two, plastic mateable brackets which have co-aligned recesses in each of them, the brackets being secured together to encompass a horizontally disposed rail on a loom harness, one of the brackets extending for a portion beyond the end of the other bracket.

The extended portion of the bracket has a metal plate mounted thereon, the plate having a rectangular lower panel carrying a sidewise extending heddle rod supporting lug. The lug includes a rectangularly shaped base, spacer element of smaller dimensions than the base and a flat rectangular retaining head mounted on the outer side of the spacer element. The head has a greater dimension than the base. The heddle rod defines a laterally extending keyhole slot or opening, the larger portion of which is of sufficient dimensions to receive, therethrough, the head of the lug. The smaller neck of the slot conforms generally to the width of the spacer element so that the heddle rod is confined by the head on the lug.

The plate has a flat tongue of smaller width than the base, the tongue extending into the cavity formed by the brackets through an appropriate slot formed in the inner edge of the rail. The tongue and slot form a means of preventing lateral displacement of the hanger along the rail.

The second embodiment comprises the above described first embodiment plus a means for adjusting the vertical relationship between the rail and the hanger. The adjusting means includes an elongated, threaded bolt which is rotatably mounted by one end to the outer edge of the rail, the bolt being threadedly journaled through the top of the hanger. As the bolt is manually rotated, the rail is selectively lowered or raised relative to the heddle rod.

OBJECTS OF THE INVENTION

It is the principal object of the present invention to provide a heddle rod hanger for mounting on the rails of heddle frames of weaving looms, to which a heddle rod may be readily and easily attached and detached.

It is another object of the present invention to provide a heddle rod hanger which will support a heddle rod at an appropriate position in a frame and which is sufficiently rugged in design and construction that it does not readily alter the position of the heddle rod, with extended use of the frame.

It is a further object of the present invention to provide a heddle rod hanger which does not shift laterally along the rail.

It is a further object of the present invention to provide a heddle rod hanger which readily permits vertical adjustment of the relationship of the hanger and heddle rod and the rail upon which the hanger is mounted.

DESCRIPTION OF THE PREFERRED EMBODIMENT

A. First Embodiment

Figure 1:
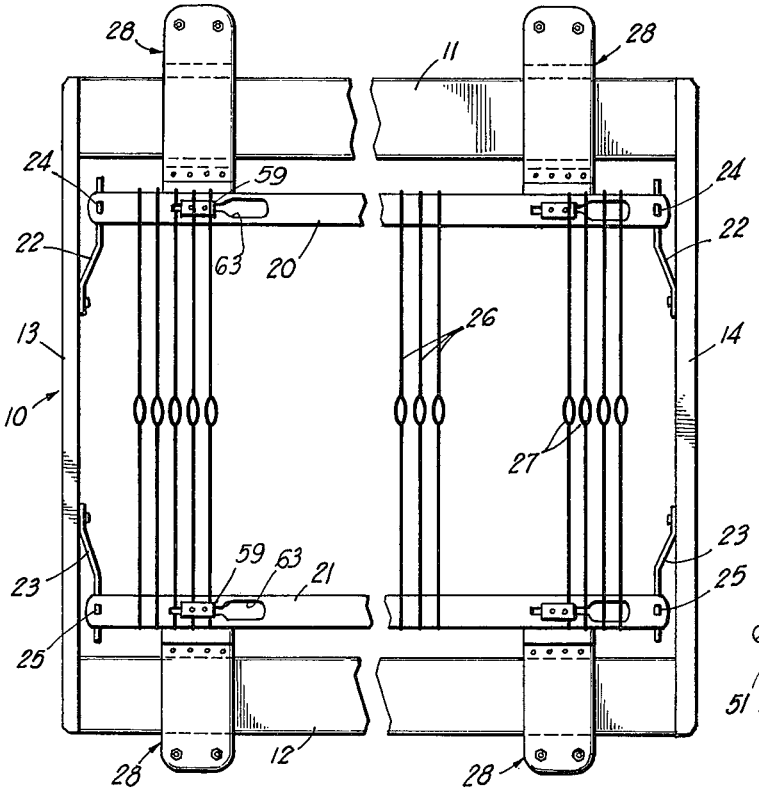
FIG. 1 is a fragmentary front elevational view of a heddle frame constructed in accordance with the present invention.

Referring now in detail to the embodiments chosen for the purpose of illustrating the present invention numeral 10 in FIG. 1 denotes generally a conventional rectangular heddle frame comprising top and bottom horizontally disposed rails 11, 12 and vertical side members or rails 13, 14 which interconnect the ends of rails 11 and 12 to maintain the rails 11, 12 in spaced parallel relationship.

Figure 3:
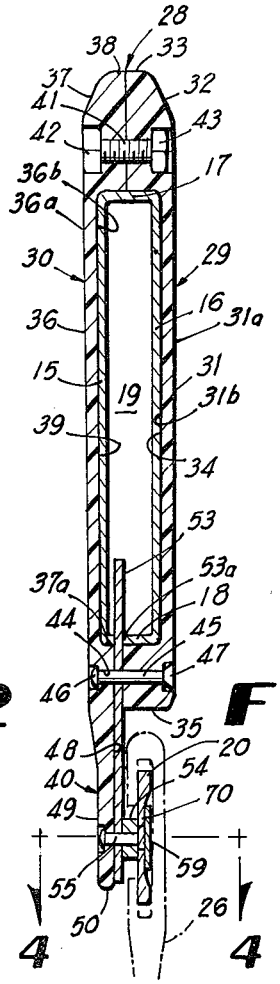
FIG. 3 is a vertical sectional view taken substantially along line 3—3 in FIG. 2.

As can be seen in FIG. 3, the rails 11, 12 are preferably made of thin, rectangularly shaped extruded steel tubing having opposed vertical walls 15, 16 joined by horizontally disposed top and bottom walls 17, 18 so as to form cavity 19, therebetween.

The heddle frame 10 further includes upper and lower heddle rods 20, 21, which are held in place at each of their ends by means of spring clips 22, 23 mounted on vertical side members 13, 14, respectively. Portions of the spring clips 22 are removeably received in apertures 24 in the end portions of upper rod 20 and portions of spring clips 23 are removeably received in apertures 25 in the end portions of lower rod 21. The heddle rods 20, 21 slideably support, therebetween, a plurality of heddles 26 having central warp eyes 27 for controlling the shed.

According to the present invention, heddle rod support hangers 28 are mounted upon the rails 11, 12 and support the heddle rods 20, 21. The heddle rod support hangers 28 can be made of any suitable material, preferably a synthetic plastic material having a low co-efficient of friction when in rubbing contact with metal rails 11, 12. Suitable materials include the plastic available under the trade name DELRIN, as well as NYLON in suitable formulations.

Figure 2:
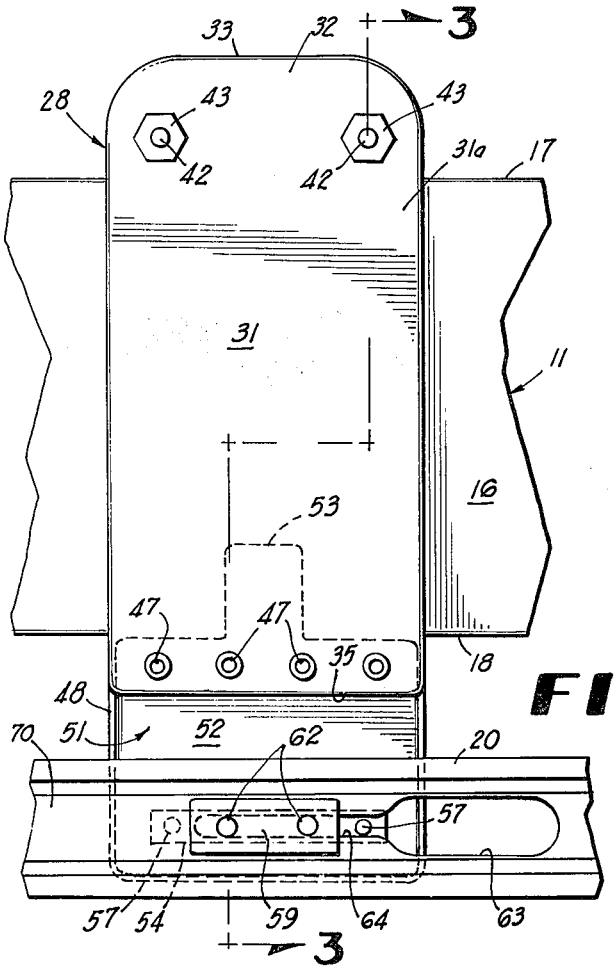
FIG. 2 is an enlarged front elevational view of a detail, showing a portion of the heddle frame depicted in FIG. 1.

Referring to FIG. 3, the support hanger 28 is comprised of two mateable or registrable brackets 29, 30. FIGS. 2 and 3 illustrate a hanger 28 which can be mounted on either top or bottom rails but for ease of structural disclosure is shown mounted on top rail 11.

The bracket 29 is a channel-shaped member having a thin central panel or wall 31 with flat parallel outer and inner surfaces **31*a* and 31*b*. The upper or outer end of panel 31 carries an upper or outer shoulder 32 which has a tapered outer surface 33 merging with surface 31*a*. The lower or inner end of panel 31 carries a lower or inner shoulder 35. The bracket 29, i.e. panel 31 and shoulders 32 and 35 define a U-shaped rail receiving recess 34. When installed on rail 11, the surface 31*b* defining recess 34 engages the outer surface of vertical wall 16 of rail 11 and the inner surfaces of shoulders 32 and 35 engage portions of the outer surfaces of walls 17, 18**, respectively.

Bracket 30 is a channel-shaped member which is larger than bracket 29 and includes vertical wall or panel 36 having outer and inner surfaces **36*a* and 36*b*. At the top, bracket 30 has an inwardly extending upper shoulder 37 which terminates in a slightly rounded top 38. A generally elongated U-shaped (in cross section) recess 39 is provided in a portion of the rear wall of bracket 30, the recess 39 being defined by surface 36*b*, shoulder 37 and lower shoulder 37*a*. Recess 39 receives the outer surface of vertical wall 15 of rail 11 and a portion of the outer surfaces of top 17 and bottom 18 of rail 11. An extended portion 40 of bracket 30 projects downwardly from wall 36, past the bottom shoulder 35 of bracket 29, for the purpose of supporting the heddle rod 20, as will be explained, hereinafter. As can be seen in FIG. 2, brackets 29 and 30** are generally rectangular in shape, when viewed from the front or back.

Spaced holes 41 are provided through brackets 29 and 30, adjacent to upper shoulders 32, 37 to receive, therethrough, threaded bolts 42 which threadedly receive nuts 43. The heads of the bolts 42 are recessed within cavities provided in bracket 29 and nuts 43 are recessed within cavities in bracket 30.

Extending through shoulder 35 and through wall 36 adjacent extended portion 40 are spaced holes 44 that receive therethrough rivets 45. The heads 46 of rivets 45 and their bradded ends 47 are recessed within wall 36 and wall 31, respectively.

Extended heddle support tongue or portion 40 is provided with a front vertical surface 48, a rear surface 49 and a rounded bottom 50. A flat plate 51 is provided between portion 40 and shoulder 35, the plate 51 being mounted flat against surface 48 and retained in place by means of rivets 45 which pass through shoulder 35, plate 51 and portion 40. The plate 51 is preferably constructed of metal.

As seen in FIGS. 2 and 3, plate 51 is substantially rectangular in shape and carries an upstanding protrusion or tongue 53 centrally provided along its upper edge, the protrusion 53 extending upwardly through a slot **53*a* in the bottom 18 of rail 11 and into cavity 19. The protrusion or tongue 53 and the slot 53*a* provide a detent means by which the support hanger 28 is secured on rail 11 and prevented from any appreciable lateral movement along rail 11. It is, of course, understood that the other hangers 28 provided on both top rail 11 and bottom rail 12 are of the same construction as discussed above, except that the hangers 28 on rail 12 are inverted so that the protrusion 53 extends downwardly into the rail cavity through a properly dimensioned slot provided in the top of rail 12**.

Figure 4:
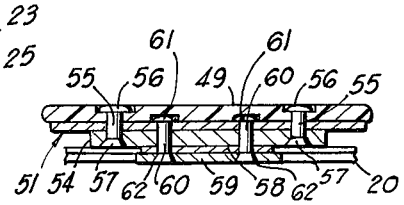
FIG. 4 is a cross-sectional view taken substantially along line 4—4 in FIG. 3.

Referring now to FIGS. 2, 3 and 4, a sidewise extending lug is provided on plate 51 for removeably mounting thereon a heddle rod 20. The lug includes a rectangularly shaped laterally extending base 54 mounted on outer surface 52 of plate 51 adjacent the bottom of plate 51 and intermediate its sides. The base 54 is secured to plate 51 by means of two rivets 55 spaced adjacent the ends of base 54, the rivets 55 extending through base 54, plate 51 and portion 40. The heads 56 and bradded ends 57 of rivets 55 are recessed within rear surface 49 and base 54, respectively. As best seen in FIG. 4, a rectangular spacer element or spacer 58 is centrally located on the outer surface of base 54, the spacer 58 being of smaller dimensions than base 54 and approximately the thickness of the narrowed central portion or channel 70 of heddle rod 20 as seen in FIG. 3. A flat retaining plate or head 59 is secured to the outer surface of spacer 58 by means of rivets 60, which extend through plate 59, spacer 58, base 54 and plate 51 with plate 51 retaining the rivet heads 61 with the balance of the rivet heads 61 being recessed into portion 40. The heads 61 of rivets 60 are recessed within portion 40, with the enlarged outer ends 62 being received through retainer plate 59. The plate 59 is of greater width than base 54 so that, in cross section, plate 59 and spacer 58 form a T.

Adjacent each hanger 28, the heddle rod 20 is provided with a laterally extending keyhole slot formed in a large dimension opening 63 and a communicating sidewise extending smaller slot 64. The opening 63 is of sufficient dimensions to receive therethrough, the retaining plate or head 59. The laterally extending slot 64 is of dimensions sufficient only to receive spacer 58 in sliding engagement therealong. With the rod 20 mounted on plate 51, the underside of retaining plate 59 engages the front surface of rod 20. Thus, a slip joint is provided between the rod 20 and hanger 28 by means of plate 59, spacer 58, opening 63 and slot 64.

As best seen in FIGS. 2 and 3, the central portion of heddle rod 20 is of reduced thickness throughout its length to form a central channel 70 within which the head 59 is recessed. Thus, the outer surface of head 59 is approximately flush with the outer surfaces of the heddle rod 20 and hence the heddle 26 will slide along rod 20, unobstructed by head 59.

With the above described construction, the vertical force imparted to the rod 20 carried by the plate 51 in weaving is carried to the rivets 45 rather than to the extended portion 40.

B. Operation of First Embodiment

Brackets 29, 30, which are joined together adjacent one of their ends by means of rivets 45, are secured to rail 11 by having protrusion 53 engage slot **53*a* in rail 11. Nuts 42 and bolts 43 are then utilized to secure the top portions of brackets 29, 30** together.

The rod 20 is mounted onto support hanger 28 by having retaining plate or head 59 completely pass through opening 63. The rod 20 is then moved to the right, as shown in FIG. 2, so that the slot 64 snugly engages the spacer 58, with plate 59 outwardly of the surface of the central portion of rod 20. A plurality of heddles 26 can then be vertically supported from rods 20, 21 as shown in FIGS. 1 and 3.

If the rods 20, 21 should break or fail in any way, the heddles 26 can be removed therefrom and the rods 20, 21 removed from their respective support hangers 28 via the slip joint as described above. In this manner, the hangers 28 do not have to be removed from the rails 11, 12, as was usually the case when the rods were integrally joined to the support hangers.

The fact that rod 20 is detachably secured to the hanger 28 allows for a very much shortened downtime for heddle frame 10 than with previous heddle rod support structures which also serve as nose guides.

C. Second Embodiment

Figure 5:
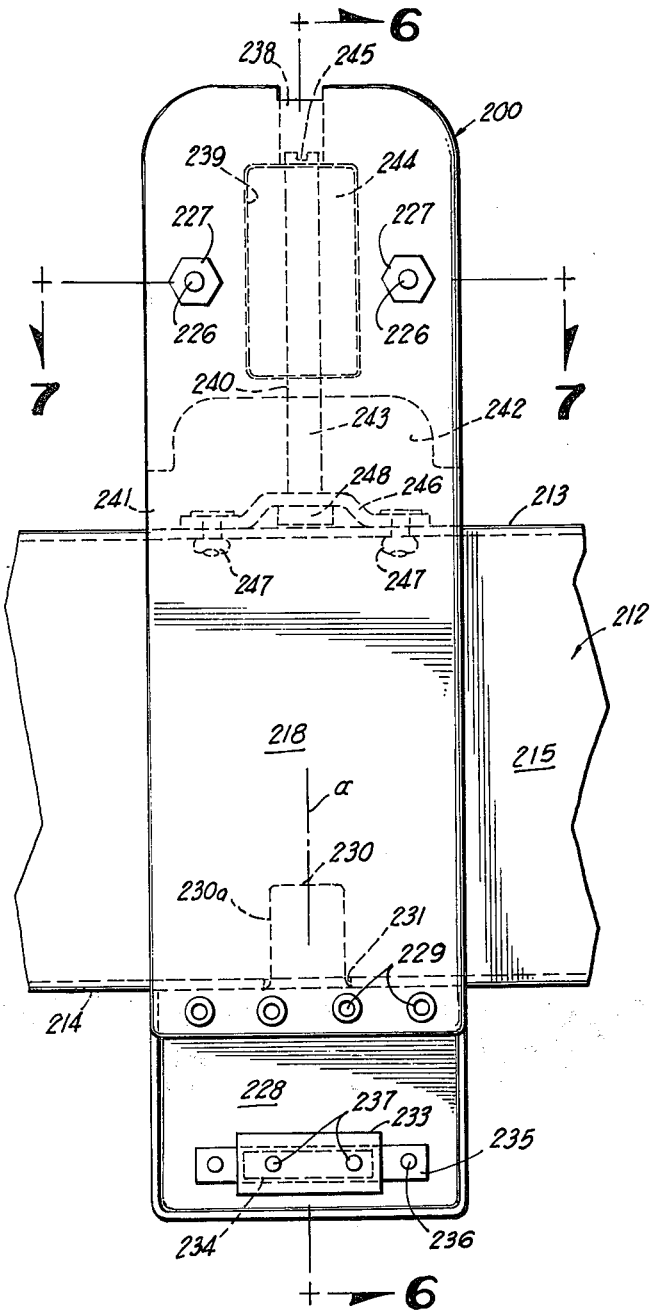
FIG. 5 is an enlarged front elevational view similar to FIG. 2 and showing a portion of the second embodiment of the present invention.
Figure 6:
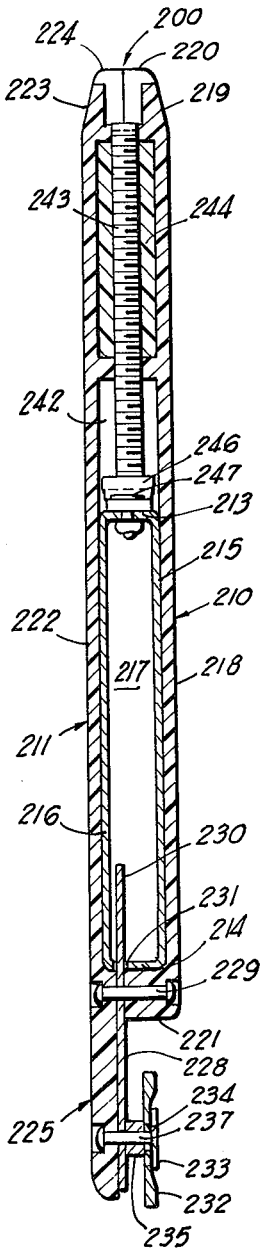
FIG. 6 is a vertical sectional view taken substantially along line 6—6 in FIG. 5 and showing the hanger of FIG. 5 supporting a heddle rod.
Figure 7:
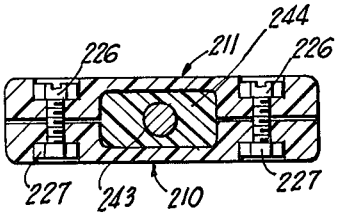
FIG. 7 is a cross-sectional view taken substantially along line 7—7 in FIG. 5.

The second embodiment of the support hanger is shown in FIGS. 5–7 and is referred to generally by the numerals in the 200 series. The second embodiment is essentially of the same construction as the first embodiment with the additional provision of a means for adjusting the relative vertical positions of the rail and the heddle rod.

Hanger 200 comprises two unitary facing C-shaped brackets 210 and 211 which are disposed in surrounding relationship to metal rail 212, the rail 212 including horizontal top and bottom edges 213, 214 joined by vertical walls 215, 216 to define interior cavity 217.

Bracket 210 has a forward vertical wall 218 which has an inwardly directed top shoulder 219 which terminates in rounded portion 220. The bottom of wall 218 terminates in horizontal shoulder 221.

Bracket 211 includes vertical wall 222 having upper or top shoulder 223 which terminates in rounded top 224. A tongue or downwardly extended portion 225 projects from bracket 211 past shoulder 221. The top portions of brackets 210, 211 are joined by bolts 226 and nuts 227. The heads of bolts 226 and the nuts 227 are recessed within brackets 211 and 210, respectively, as seen in FIG. 7.

A reinforcing movement arresting plate 228 is mounted on portion 225 by means of rivets 229 extending through shoulder 221, plate 228 and wall 222. As seen in FIG. 6, the heads and ends of rivets 229 are recessed within walls 222 and 218, respectively. An upstanding tongue or protrusion 230 is provided on the top of plate 228, the protrusion 230 extending through slot 231 in bottom edge 214 and into cavity 217.

The tongue 225 carries the lug which forms a means for detachably mounting a heddle rod 232 on plate 228. This lug includes an outer retainer plate 233 secured onto a spacer 234 which, in turn, is mounted onto base 235, the base 235 being secured to portion or tongue 225 by means of rivets 236. The engaging element 233 is secured to the portion 225 by additional rivets 237.

A bolt retaining opening 238 is centrally vertically disposed through the top of hanger 200 and communicates with an enlarged rectangularly shaped, block receiving chamber 239 which, in turn, communicates with a lower cavity 241 through a lower bolt hole 240. Cavity 241 extends laterally through hanger 200 to receive rail 212 therein, the central portion of the cavity being enlarged, at numeral 242.

An elongated, externally threaded bolt 243 is threadedly carried by a plastic insert or block 244 within chamber 239. The top of bolt 243 is provided with a slot 245 for turning adjustment of bolt 243 by means of a screwdriver.

The lower end portion of bolt 243 extends through and is journaled by a metal retaining bracket 246, the bracket 246 being mounted to the top edge 213 of rail 212 by rivets 247. The lower end of bolt 243 is provided with a head 248 which arrests outward movement of the bolt 243 from the bracket 246 while permitting rotation of the bolt 240.

D. Operation of Second Embodiment

The hanger 200 is mounted on rail 212 by securing the bracket 246 to the upper edge 213, as shown in broken lines in FIG. 5. The bolt 240 thus stands upright with the plastic insert or block carried thereon. Next the assembled brackets with the metal plate 228 therein with all rivets secured is placed in position upon the rail 212 with the tongue 230 inserted into hole or aperture 231. Thereafter, the brackets 210 and 211 are brought together for surrounding the rail 212 and for receiving the block 244 within the cavity 239. The bolts 226, and nuts 227 are then appropriately installed. Next, the heddle rod 232 is inserted onto the lug, i.e., over plate 233, so that the smaller portion of the keyhole slot of rod 232 snugly encompasses the spacer 234.

When it is desired to adjust vertically the relationship between the rod 232 and the rail 212, the bolt 243 is manually rotated about its axis within insert 244 by means of a screwdriver inserted into slot 245. As the bolt 243 is manipulated, the rail 212 is extended into or retracted from cavity 241 thereby moving hanger 200 upwardly or downwardly.

Since the upstanding protrusion of tongue 230 is longer than the maximum normal travel of the bolt 243 and is disposed radially on both sides of an extension of the axis *a*, its sides 230*a* being parallel to axis *a* of the bolt 243, the lateral movement of hanger 200 will be arrested, while vertical movement of hanger 200 is controlled by bolt 243.

What is claimed is:

1. A heddle rod hanger assembly for mounting on a rectangular shaped heddle frame rail having horizontal top and bottom edges and vertical side walls, comprising:

(a) a substantially rectangular shaped first section having first front and first rear walls and first recessed area defined by said first rear wall;

(b) a substantially rectangular shaped second section having second front and second rear walls, a second recessed area defined by said second rear wall for registering with said first recessed area, said first and second sections being mateable for engagement with each other so as to encompass said rail within a cavity formed by said recessed areas, said second section being of greater length than said first section so as to form an extended portion;

(c) each of said sections being of molded synthetic plastic material;

(d) mounting means for mounting a heddle rod on said hanger, said mounting means comprising a metal plate carried in a vertically disposed position against said extended portion, and an element extending from an inner portion of said plate for supporting said rod in spaced relationship to said rail, the upper portion of said plate being received within said cavity and said second section.

2. A heddle rod hanger assembly as claimed in claim 1 wherein said plate is a flat member carried flush against said extended portion of said second section.

3. A heddle rod hanger assembly as defined in claim 1 including rivets passing through the bottom portion of said first section, said plate and said second section for securing the same together.

4. A heddle rod hanger assembly as claimed in claim 1 wherein said plate includes a protrusion along its top edge which extends into said cavity and a slot in an edge of said rail of suitable dimensions to receive therein said protrusion for preventing the appreciable lateral movement of said hanger on said rail.

5. A heddle rod hanger assembly as claimed in claim 1 wherein one edge of said cavity is of sufficient width to allow the vertical movement of said rail therein and wherein said assembly is provided with means to adjust the vertical alignment of said hanger and said rail, said adjusting means includes a threaded bolt vertically extending through said hanger into said cavity, said hanger being threaded to receive said bolt therethrough, and means for securing the bottom of said bolt to an edge of said rail.

* * * * *